US005677059A

United States Patent [19]

Kakita et al.

[11] Patent Number: 5,677,059

[45] Date of Patent: Oct. 14, 1997

[54] FIBER FOR ARTIFICIAL HAIR HAVING EXCELLENT BULKINESS

[75] Inventors: Naohiko Kakita, Kobe; Kenichiro Cho, Takasago; Hiroyuki Nakashima, Kakogawa; Nobuyuki Nishi, Takasago; Koichi Nishiura, Akashi, all of Japan

[73] Assignee: Kanegafuchi Kagaku Kogyo Kabushiki Kaisha, Osaka, Japan

[21] Appl. No.: 644,899

[22] Filed: May 10, 1996

[30] Foreign Application Priority Data

May 10, 1995 [JP] Japan ..... 7-111779

[51] Int. Cl.[6] ..... D02G 3/00

[52] U.S. Cl. ..... 428/397; 428/364; 428/376

[58] Field of Search ..... 428/376, 364, 428/397; 132/200, 201; 57/4

[56] References Cited

U.S. PATENT DOCUMENTS

| | | | |
|---|---|---|---|
| 1,773,969 | 8/1930 | Dreyfus | 428/397 |
| 2,637,893 | 5/1953 | Shaw | 428/397 |
| 3,121,040 | 2/1964 | Shaw et al. | 428/397 |
| 3,238,553 | 3/1966 | Bailey et al. | 428/397 |
| 3,440,129 | 4/1969 | Anselm | 428/397 |
| 3,746,827 | 7/1973 | Martin et al. | 428/397 |
| 3,910,291 | 10/1975 | Kim | 132/201 |
| 4,311,761 | 1/1982 | Kanbarg et al. | 428/397 |
| 5,380,592 | 1/1995 | Tung | 428/376 |

FOREIGN PATENT DOCUMENTS

| | | | |
|---|---|---|---|
| 3145409 | 6/1988 | Japan | 428/397 |

*Primary Examiner*—Newton Edwards

*Attorney, Agent, or Firm*—Armstrong, Westerman, Hattori, McLeland & Naughton

[57] ABSTRACT

Fiber for artificial hair having an excellent bulkiness and also a soft feeling like the human hair, as compared with conventional fibers, are provided. The fiber comprise synthetic fibers, wherein an apparent bulk specific gravity of the fiber before crimping is within a range of from 0.1 to 0.2, an apparent bulk specific gravity of the fiber after crimping is within a range of from 0.02 to 0.05, a cross-section of the fiber is a modified cross-sectional shape comprising one central connecting portion, and projections extended in at least three directions from the central connecting portion, part of a surface or the entire surface of the fiber is open in the longitudinal direction of the fiber, and the fiber has a single yarn fineness of from 25 to 75 denier.

11 Claims, 7 Drawing Sheets

FIBER FOR ARTIFICIAL HAIR HAVING EXCELLENT BULKINESS

FIELD OF THE INVENTION

The present invention relates to a fiber for artificial hair having an excellent soft feeling and a bulkiness, which can be used for the decoration of hair on the head such as wigs, hair pieces, braid, extension hair and doll's hair.

BACKGROUND OF THE INVENTION

In general, modacrylic fibers, vinyl chloride fibers, vinylidene chloride fibers, polyester fibers, nylon fibers, and the like are known as synthetic fibers to be used for artificial hair. Conventionally, when articles for artificial hair such as wigs or hair pieces are formed using those fibers, if a soft feeling is pursued in the articles, fibers having a large specific gravity such as vinyl chloride fibers have been selected. Further, if a bulkiness is required to the articles, fibers having small specific gravity such as modacrylic fibers have been selected. Thus, the selection of the fibers has been required depending on the articles to be intended.

In order to avoid such a complicated selection of the fibers as much as possible, an improvement is made on a cross-sectional shape of the fibers. For example, JP-A-55-76102 proposes to exhibit properties near the human hair by employing the cross-section such as an approximately star shape or a cocoon shape. (The term "JP-A" used herein means a "Japanese Unexamined Patent Publication"). However, in general, when a fiber having a substantially circular cross-sectional shape is used, the use of such a fiber is suitable to obtain a soft feeling and for straight hair style, but not suitable for braid articles that require a bulkiness.

As a fiber for artificial hair that can obtain an article having the bulkiness and being rich in volume, JP-U-A-56-42980 (corresponding to JP-U-B-58-37961) proposes a fiber capable of increasing the bulkiness by improving the cross-sectional shape of the fiber. (The terms "JP-U-A" and "JP-U-B" used herein mean a "Japanese Unexamined Utility Model Publication", and a "Japanese Examined Utility Model Publication", respectively). In that proposal, the fiber has a three-forked, Y-shaped cross-section, and the bulkiness to a certain extent is obtained by such a cross-sectional shape. However, projections extended from a central portion of the cross-section have an approximately rectangular shape, and such a fiber has a slightly rigid feeling. As a result, it has been found that such a fiber is not always sufficient in order to simultaneously satisfy both the soft feeling and the bulkiness for the decoration of hair.

JP-U-A-58-65316 (corresponding to JP-U-B-63-48652) proposes a fiber having a bulkiness by a hollow cross-section, wherein the cross-section is formed by 3 to 6 T-shaped projections which are arranged radially from a center of the cross-section, and a top edge of each projection is brought into contact with the top edges of both the adjacent projections. However, when such a fiber is used, there is a problem that articles formed using such a fiber have rigid feeling due to strong flexural rigidity, although a good effect is obtained in the bulkiness.

SUMMARY OF THE INVENTION

As a result of extensive study to impart a soft feeling like a human hair's to synthetic fibers and also to increase the bulkiness of the fibers, it has been found that a fiber for artificial hair having an excellent bulkiness can be obtained by using the fiber having a specific modified cross-section. The present invention has been completed based on this finding.

Accordingly, an object of the present invention is to provide a fiber for artificial hair having an improved bulkiness and an excellent soft feeling compared with the conventional fibers.

According to a main embodiment of the present invention, there is provided a fiber for artificial hair comprising synthetic fibers, wherein an apparent bulk specific gravity of the synthetic fibers before crimping is within a range of from 0.1 to 2.0, a cross-section of the fiber is a modified cross-sectional shape comprising one connecting portion and projections extended in at least three directions from the connecting portion, and part of the surface or the entire surface of the fiber is open in the longitudinal direction of the fiber.

In a preferred embodiment of the present invention, there is provided a fiber for artificial hair, wherein the apparent bulk specific gravity of the synthetic fibers after crimping is within a range of from 0.02 to 0.05.

In a another preferred embodiment of the present invention, there is provided a fiber for artificial hair, wherein the synthetic fibers have a single yarn fineness of from 25 to 75 denier.

In a further preferred embodiment of the present invention, there is provided a fiber for artificial hair, wherein the synthetic fibers have an approximately Y-shaped cross-section comprising one central connecting portion and projections extended in at least three directions from the central connecting portion.

In still a further preferred embodiment of the present invention, there is provided a fiber for artificial hair, wherein the fiber is used for the decoration for hair such as wigs, hair pieces, braids or extension hair.

DETAILED DESCRIPTION OF THE INVENTION

The term "apparent bulk specific gravity of fibers before crimping" used herein means a bulk specific gravity measured under the following conditions.

Figure 1A:
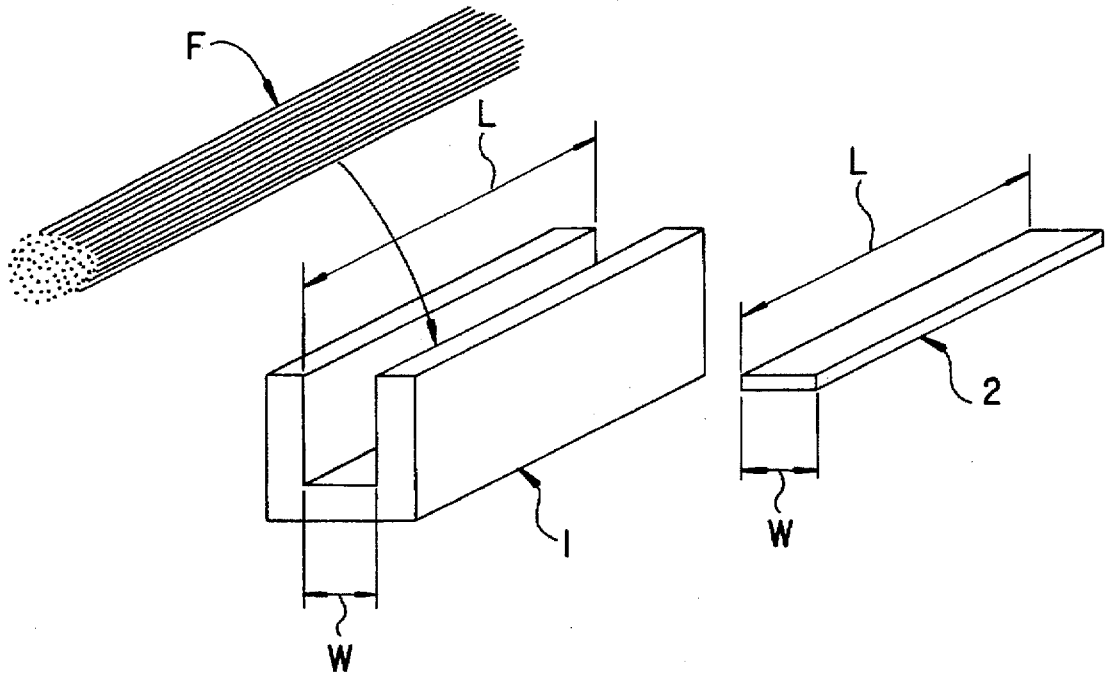
FIGS. 1(*a*) and 1(*b*) are explanatory views showing a method for measuring a bulk specific gravity of fibers before crimping, in which FIG. 1(*a*) is a perspective view of a measurement vessel, and FIG. 1(*b*) is a cross-sectional view of the measurement vessel at measurement.
Figure 1B:
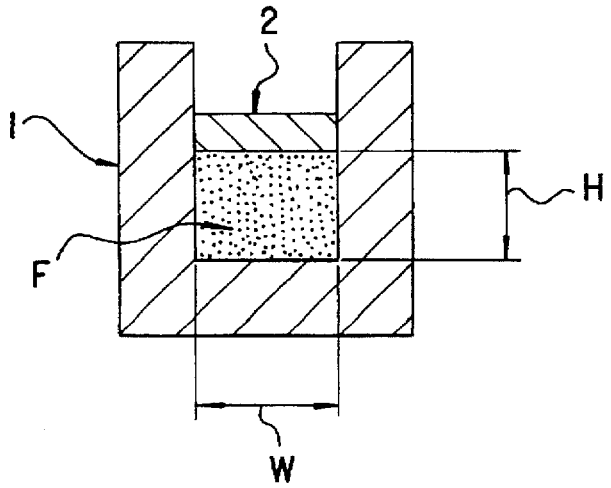
Figure 2A:
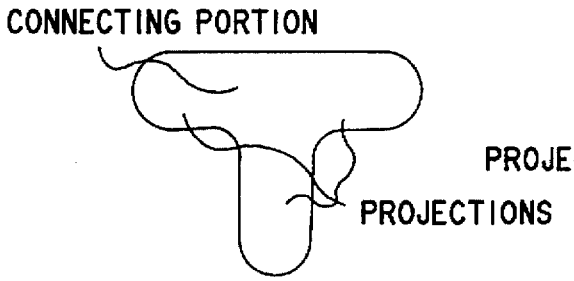
FIGS. 2(*a*) to 2(*e*) are cross-sectional views showing various cross-sectional shapes of the fibers according to the present invention.
Figure 2B:
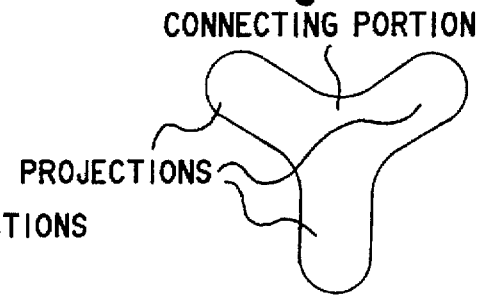
Figure 2C:
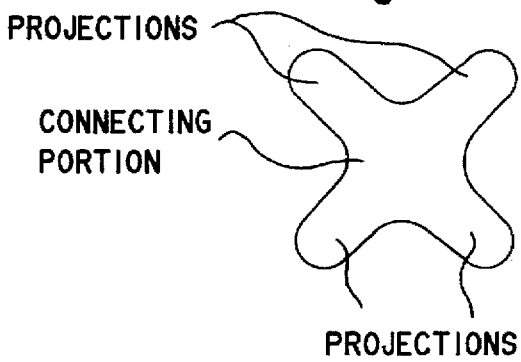
Figure 2D:
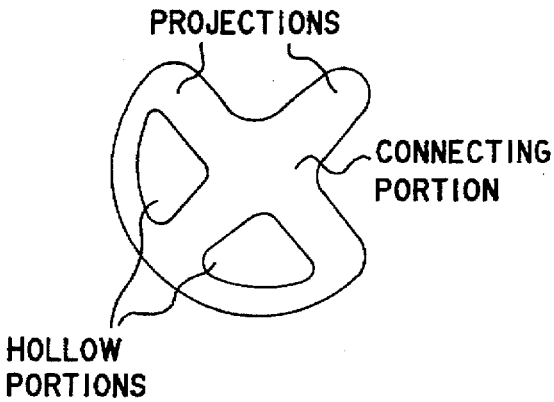
Figure 2E:
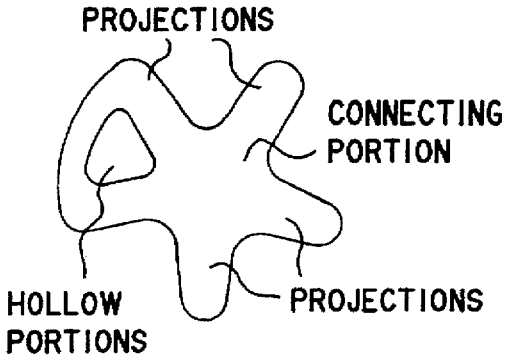

A fiber bundle before crimping is accurately cut into 1 m length, and 200 g of the cut bundle are weighed out (total fineness is 1,800,000 denier) to obtain a fiber bundle F. This fiber bundle F is placed in a groove of a grooved vessel 1 with the groove having a size of a length (L) of 30 cm and a width (W) of 6 cm and having both open ends as shown in FIG. 1(*a*). A thin plate 2 having the same size as the size of the groove is placed on the fiber bundle placed in the groove from the upper, and a load of 0.25 g/cm$_2$ is applied to the thin plate 2. The specific gravity $E_0$ of the fiber bundle F in the grooved vessel 1 after 1 minute from the application of load is defined as an apparent bulk specific gravity, and is calculated by the following equation (1):

$$E_0=60/(180\times H) \quad (1)$$

wherein H is a height (cm) of from an inside bottom of the grooved vessel 1 to a lower face of the thin plate 2 as shown in FIG. 1(*b*).

Further, the term "apparent bulk specific gravity of fibers after crimping" used herein means a bulk specific gravity measured under the following conditions:

100 g of a fiber bundle before crimping are weighed out (total fineness is 900,000 denier), the fiber bundle is subjected to crimping, and the fiber bundle is sufficiently subjected to setting with comb or the like so as to make the fiber bundle uniform. The fiber bundle is adjusted as follows. A crimped shape, wherein a total length of the height of a crest and the depth of a root which are adjacent with each other is from 5 to 8 mm on the average comprises 5 to 10 crimps as a repeating unit of the crest and root in a distance of 100 mm of the fiber in an axial direction, to obtain fiber bundle F'. In the same manner as in the measurement of an apparent bulk specific gravity before crimping as described above, the fiber bundle F' is placed in the vessel 1 shown in FIG. 1(*a*), the thin plate 2 having the same size as the size of the groove is placed on the fiber bundle from above, and a load of 0.25 g/cm$^2$ is applied to the thin plate 2. Then, a height (H) shown in FIG. 1(*b*) after 1 minute of the application of the load, which is the height (cm) of from the inside bottom of the grooved vessel to the lower face of the thin plate 2, is measured. The fiber bundle portions projected from the grooved vessel 1 are cut off, and a weight G (g) of the fiber bundle remained in the grooved vessel is measured. The specific gravity $E_1$ of the fiber bundle F' is defined as an apparent bulk specific gravity after crimping, and is calculated by the following equation (2):

$$E_1=G/(180\times H) \quad (2)$$

wherein H is the same as defined above.

The synthetic fibers that constitute the fiber for artificial hair of the present invention are not particularly limited, and the examples thereof include modacrylic fibers, vinyl chloride fibers, vinylidene chloride fibers, polyester fibers, polyamide fibers, and polyolefin fibers. In order to obtain the desired qualities having an excellent soft feeling and a bulkiness, fibers having a relatively low Young's modulus, such as modacrylic fibers or vinyl chloride fibers, are suitable for processability for imparting crimps and to obtain a soft feeling. Further, modacrylic fibers having a low specific gravity are more preferred in order to achieve an excellent bulkiness. As long as the fibers are used for the decoration of hair, it is preferred for polyolefin fibers such as polypropylene fiber (and also polyester fibers and polyamide fibers) to be imparted flame retardance on the purpose of use of the articles formed therefrom. The polyolefin fibers are excellent in polymer specific gravity, and the desired high bulk specific gravity is liable to be obtained.

The modified cross-sectional shape intended in the present invention, in which the cross-section comprises one central connecting portion and projections extended in at least three directions from the central connecting portion, and part of the surface or the entire surface of the fiber is open in the longitudinal direction of the fiber, includes not only T-Shaped, Y-shaped and X-shaped cross-sections as shown in FIGS. 2(*a*) to 2(*c*) having projections radially extended from the center of the connecting portion, with the entire surface of the fiber being open in the longitudinal direction of the fiber, but also the modified cross-sectional shape includes cross-sections as shown in FIGS. 2(*d*) and 2(*e*), in which top edges of the adjacent projections are connected with each other to form hollow portions, and only a part of the surface of the fiber is open in the longitudinal direction of the fiber. However, although the cross-section having hollow portions as shown in FIGS. 2(*d*) and 2(*e*) is excellent in a bulkiness, fibers having such cross-sections tend to be rigid. In order to obtain the desired fiber having an excellent bulkiness and a soft feeling according to the present invention, a cross-sectional shape in which all portions formed between a projection and the adjacent projection are open is more preferred as shown in the FIGS. 2(*a*) to 2(*c*).

The number of the projections extended from the central connecting portion may be at least three, but if the cross-section has 7 or more projections, fibers having a large specific gravity become poor in a bulkiness. Therefore, the number of the projections in the cross-section is preferably from 3 to 6, and more preferably 3 or 4.

A shape of the projections may be a shape that a width of the projection of from the central connecting portion to the top edge is not constant. A taper shape having a width gradually narrowed toward the top edge is preferred.

Another preferred shape is that a portion where it is nearer to the top edge of the projection than ½ of a length R, which is from the central connecting portion to the top edge of the projection, is most narrowed, and a width gradually increases toward the top edge from the most narrowed portion.

Figure 3:
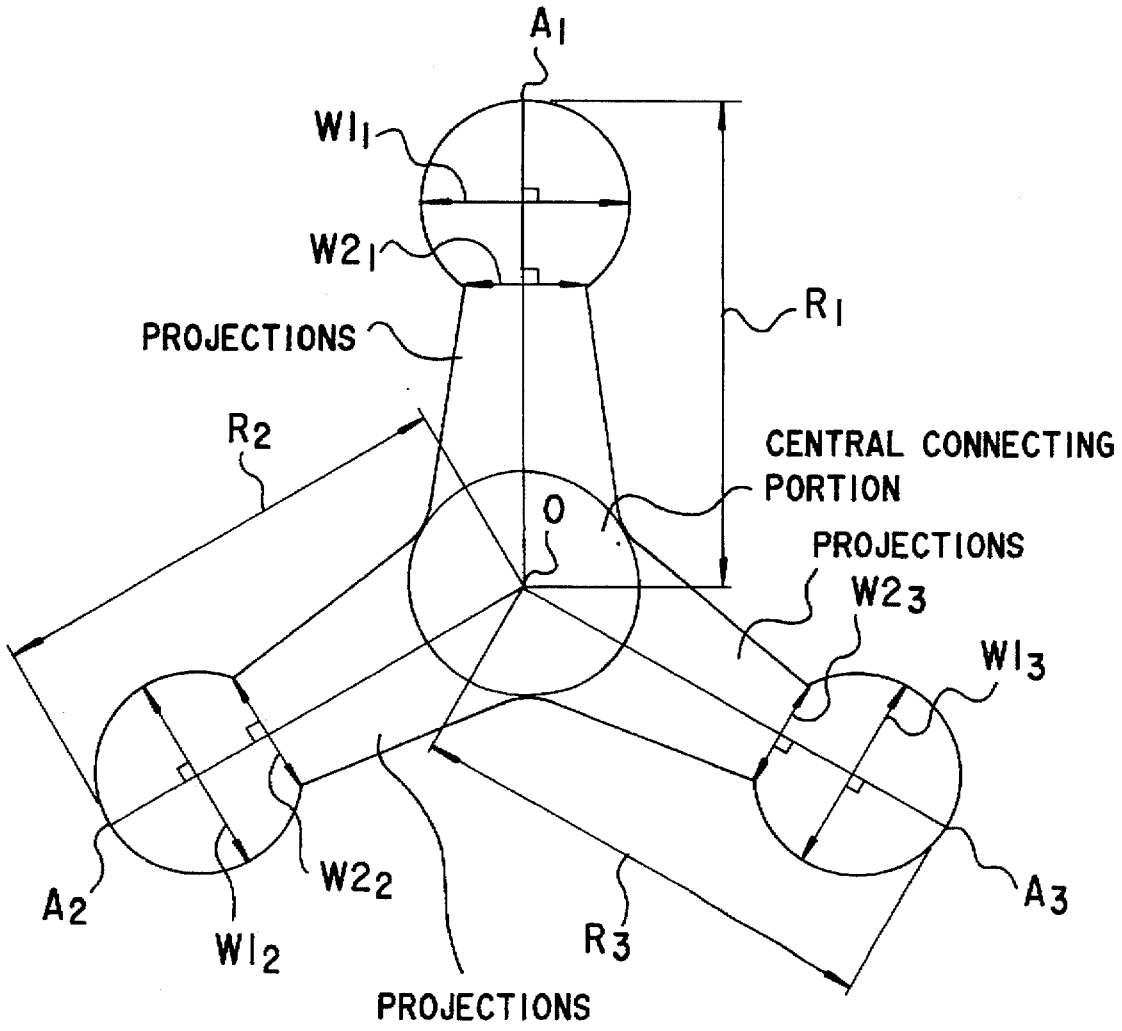
FIG. 3 is an explanatory view showing the dimensions of a preferred cross-sectional shape of the fiber according to the present invention.

Further preferred shape is a cross-section as shown in FIG. 3. The cross-section comprises one central connecting portion, and projections extended in three directions from the central connecting portion, where the entire surface of the fiber is open in the longitudinal direction of the fiber. At least one of the projections is most narrowed at a portion where it is nearer to the top edge of the projection than ½ of the length, which is from the center of the central connecting portion to the top edge of the projection. A ratio of W1/W2 is within a range of from 1.05 to 2.0, wherein W1 is a width at the widest portion in the portion where it is nearer to the top edge from the most narrowed portion, and W2 is a width of the most narrowed portion. Further, a ratio of R/W1 is within a range of from 1.10 to 5.0, where R and W1 are the same as defined above.

Namely, it is preferred that at least one of the projections extended in three directions is not a rectangular shape as in the conventional cross-section, but is narrowed. By forming a cross-sectional shape having the narrowed portions in the projections, fibers having a predetermined bulk specific gravity and also having an excellent soft feeling and a bulkiness can be obtained, compared to the conventional fibers.

The W1/W2 ratio is from 1.05 to 2.0, and preferably from 1.05 to 1.5. If the W1/W2 ratio is less than 1.05, the number of the narrow top edge portions increases depending on the types of the synthetic fibers used, and the fiber may be liable to crack at crimping or the like. On the other hand, if the W1/W2 ratio is larger than 2.0, the balance in the dimension of the cross-section as the whole is destroyed, and the width W2 at the most narrowed portion becomes too narrow, so that the problem may occur that fibers are liable to crack at the production of the fiber. As a result, the bulkiness purposed in the present invention may not be achieved.

The R/W1 ratio is from 1.10 to 5.0, and preferably from 2.0 to 4.0. If the R/W1 ratio is less than 1.10, an area effect as the projection may be lost. On the other hand, if the R/W1 ratio is larger than 5.0, the width of the projections as a whole becomes too narrow, and the fibers may bend. As a result, the bulkiness purposed in the present invention may not be achieved.

Figure 4:
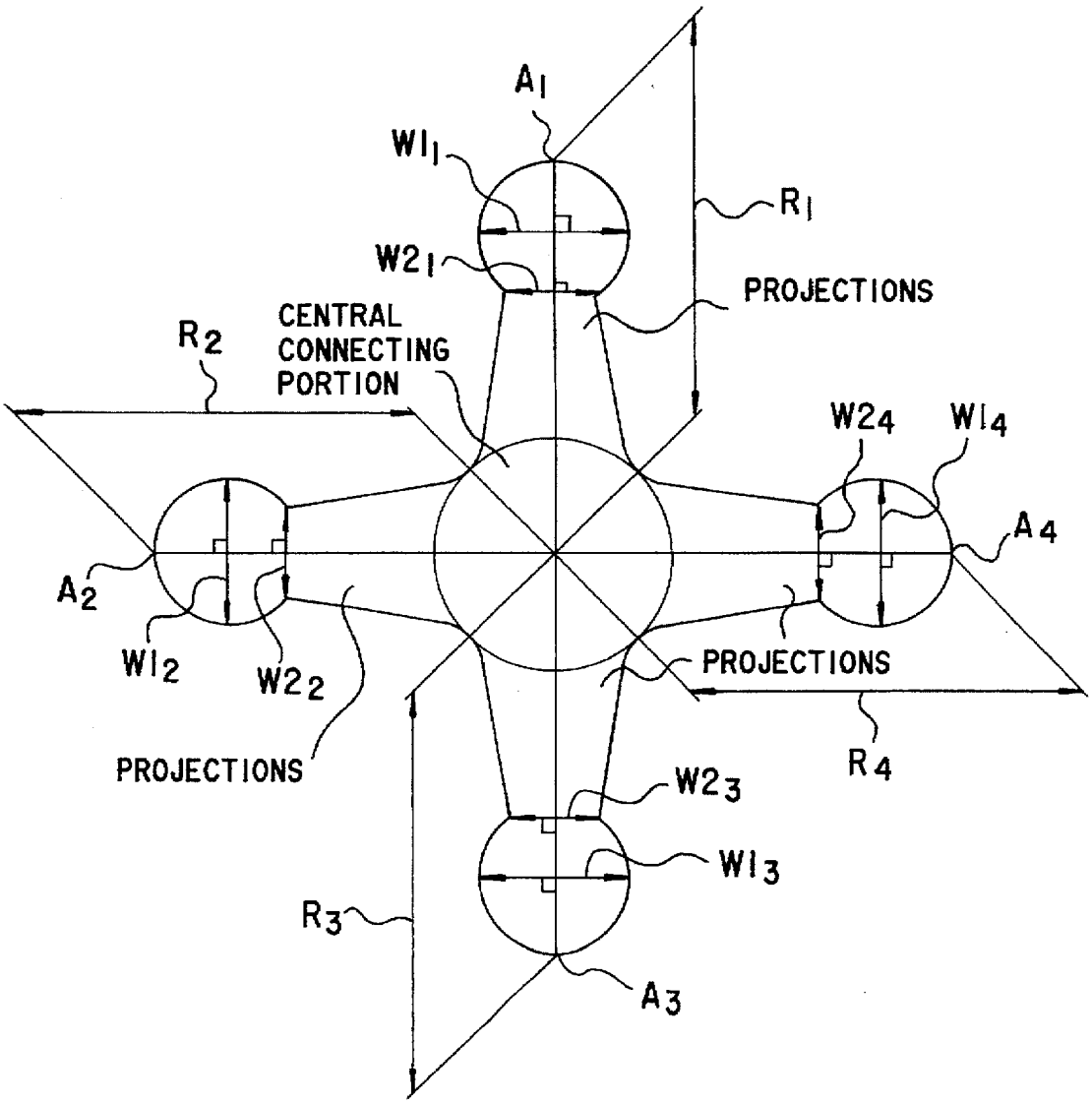
FIG. 4 is an explanatory view showing another preferred cross-sectional shape of the fiber according to the present invention.

Incidently, as shown in FIG. 4, the center of the central connecting portion in the cross-section of a fiber means a center O in an inscribed circle of the central connecting portion in the cross-section of a fiber. The top edges of the projections mean points $A_1$, $A_2$, and $A_3$ in the projections, which are farthest from the center O of the central connecting portion. The width W1 which is a width of the widest portion in the portion where it is nearer to the top edge from the most narrowed portion of the projection, and W2 which is a width of the most narrowed portion mean widths $W1_1$, $W1_2$ and $W1_3$, and $W2_1$, $W2_2$ and $W2_3$ in the portions in the direction crossing lines which connect the center O of the central connecting portion and the top edges $A_1$, $A_2$ and $A_3$ of each projection, respectively.

More preferred embodiment of the cross-section is that at least two of the projections are most narrowed at the portions where they are nearer to the top edges of the respective projections than ½ of the length R, which is from the center of the central connecting portion to the top edge of the respective projection, a ratio of W1 max/W1 min is within a range of from 1.05 to 1.7 wherein W1 max is a maximum value of the width W1 in the widest portion nearer to the top edge of the projection than the most narrowed portion, and W1 min is a minimum value in the widest portion nearer to the top edge of the projection than the most narrowed portion, and a ratio of R max/R min is within a range of from 1.05 to 1.5 wherein R max is a maximum value of a length R of from the center of the central connecting portion to the top edge of each of the projections, and R min is a minimum value in the length R.

The maximum value W1 max and the minimum Value W1 min of the width W1, which is the widest portion in the portion where it is nearer to the top edge from the most narrowed portion of the projection, mean, for example, the maximum value and the minimum value, respectively, in the widths $W1_1$, $W1_2$ and $W1_3$, of the widest portion in the portion where it is nearer to the top edge from the most narrowed portion in each projection in the cross-section of a fiber as shown in FIG. 3. The maximum value R max and the minimum value R min of the length R of from the center of the central connecting portion to the top edge of the projection mean a maximum value and a minimum value, respectively, in the lengths $R_1$, $R_2$ and $R_3$ of from the center of the central connecting portion to the top edges $A_1$, $A_2$ and $A_3$.

The cross-section comprising the central connecting portion and the projections extended in three directions from the central connecting portion as shown in FIG. 3 is described as the preferred embodiment of the cross-section, but the preferred cross-sectional shape further includes a cross-section comprising a central connecting portion, and projections extended in four directions from the central connecting portion, as shown in FIG. 4. This cross-section is explained below.

The central connecting portion has four projections extended therefrom, and the entire surface of the fiber is open in the longitudinal direction of the fiber. At least one of the projections is most narrowed at a portion where it is nearer to the top edge of the projection than ½ of a length R, which is from the center of the central connecting portion to the top edge of the projection. A ratio of W1/W2 is within a range of from 1.05 to 2.0, and preferably from 1.05 to 1.5 wherein W1 is a width, of the widest portion in a portion where it is nearer to the top edge from the most narrowed portion, and W2 is a width of the most narrowed portion. A ratio of R/W1 is within a range of from 1.10 to 5.0, and preferably from 2.0 to 4.0 wherein R and W1 are the same as defined above.

As shown in FIG. 4, the center of the central connecting portion in the cross-section of a fiber means a center O of an inscribed circle in the cross-section of a fiber. The top edges of the projection means points $A_1$ to $A_4$ which are farthest from the center O of the central connecting portion. Further, the width W1, the widest portion in the portion where it is nearer to the top edge from the most narrowed portion of the projection, and the width W2, the most narrowed portion mean widths $W1_1$ to $W1_4$, and $W2_1$ to $W2_4$, respectively, in each portion in the direction crossing lines which connect the center O of the central connecting portion and the top edges $A_1$ to $A_4$.

Further, at least two of the projections are most narrowed at the portions where it is nearer to the top edges of the respective projections than ½ of the length of from the center of the central connecting portion to the top edge of each projection. A ratio of W1 max/W1 min is preferably within a range of from 1.05 to 1.7 wherein W1 max is a maximum value of the width W1, which is the widest portion in the portion where it is nearer to the top edge from the most narrowed portion, and W1 min is a minimum value of the width W1, which is the widest portion in the portion where it is nearer to the top edge from the most narrowed portion. A ratio of R max/R min is preferably within a range of from 1.05 to 1.5 wherein R max and R min are a maximum value and a minimum value, respectively, of the length R, which is from the center of the central connecting portion to the top edge of each projection.

The maximum value W1 max and the minimum value W1 min of the widest portion in the portion where it is nearer to the top edge from the most narrowed portion mean, for example, a maximum value and a minimum value, respectively, in widths $W1_1$ to $W1_4$, which are the widest portions in the portion where it is nearer to the top edge from the most narrowed portion in the projection in the cross-section of the fiber as shown in FIG. 4. The maximum value R max and the minimum value R min of the length R, which is from the center of the central connecting portion to the edge of the projection mean a maximum value and a minimum value, respectively, in lengths $R_1$ to $R_4$ of from the center O of the central connecting portion to the top edges $A_1$ to $A_4$ of each projection.

As a nozzle used in producing the fibers for artificial hair of the present invention, a nozzle which can obtain fibers having the cross-sectional shape as described above, such as Y shape, T shape, cross shape, or star shape, is selected. Further, in order to obtain fibers having a cross-sectional shape such that the projection is most narrowed at a portion where it is nearer to the top edge than ½ of the length R, which is from the center of the central connecting portion to the top edge of the projection, and the W1/W2 ratio wherein W1 is a width of the widest portion in the portion where it is nearer to the top edge from the most narrowed portion, and W2 is a width of the most narrowed portion, and the R/W1 ratio wherein R and W1, are the same as defined above are fallen within the specified ranges described above. It is desirable to use a spinning nozzle having a hole shape substantially near the cross-sectional shape of the desired fibers to be obtained, for example, where a melt spinning method or a dry spinning method is employed. Also, the same as above can apply to the employment of a wet spinning method. However, when a modacrylic fiber is produced using a wet spinning method, it is not always necessary for the nozzle to have a hole shape having the same cross-section as in that of the desired fibers to be obtained. Even if a nozzle of which the shape does not have a narrowed portion in the projection extended from the central connecting portion is used, a fiber having a cross-section with a narrowed portion in the projection as described above can be obtained by increasing a spinning draft.

Spinning conditions for obtaining a fiber of the present invention are not particularly limited. However, it is necessary to determine optimum conditions that meet the spinning method in order to attain a cross-sectional shape for obtaining the desired bulkiness. In the use of, for example, modacrylic fibers which are the most preferred materials, a spinning draft, when using a spinning nozzle having an approximately Y shaped cross-section, is preferably at least 1.0, more preferably from 1.1 to 1.7, and most preferably from 1.1 to 1.5.

A method of imparting crimps to a fiber of the present invention includes a gear crimping method and a stuffing box method. However, as far as a fiber is intended to be used for a decoration of hair on the head, it is only required to impart the necessary and minimum crimping shape to the fiber, and, therefore, a gear crimping method is preferred in respect of workability or the like. The shape of the gear and working conditions in such a treatment may be appropriately selected depending on types of a polymer for fibers. The crimping is conducted to impart crimps such that 5 to 10 crimping shapes as a repeating unit of a crest and a root, wherein the total length of the height of crest and the depth of root, the crest and the root being adjacent with each other, is from 5 to 8 mm on the average, are present in a length of 100 mm of a fiber in an axial direction when fiber bundle thus treated is subjected to setting sufficiently with a comb or the like, thereby the apparent bulk specific gravity after crimping of 0.02 to 0.05 intended in the present invention can be achieved. Depending on types of the polymer, the crimped shape may loosen (the average total length of the height of the crest and the depth of the root, and the number of the repeating units of the crest and the root may decrease) by subjecting the fiber bundle to setting, such as with a comb. Therefore, it is desirable to expand the upper limits in the steps of imparting crimps such that the average total length of a height of the crest and the depth of root is from 5 to 12 mm, and the number of the repeating units of the crest and the root is from 5 to 15. However, if the number of the repeating units of the crest and the root is too large, although a bulkiness is improved, problems may occur that the loss due to such an excess length is large, volume is too large, hair style is not well arranged, and workability such as knitting decreases. On the other hand, if the number of the repeating units after subjecting the fiber bundle to setting with a comb is less than 5, the bulkiness decreases, and the commercial value of an article is reduced. Therefore, the crimping shape having the number of the repeating units of about 5 is preferable.

It is preferred for a fiber for artificial hair of the present invention to have a single yarn fineness in a range of from 25 to 75 denier, but in order to emphasize a soft feeling, the fineness of from 25 to 40 denier is more preferred.

The present invention is described in more detail with reference to the following Examples and the Comparative Examples, but it should be understood that the invention is not construed as being limited thereto. Unless otherwise indicated, denier is expressed by "d" for the brevity.

EXAMPLE 1

Figure 5:
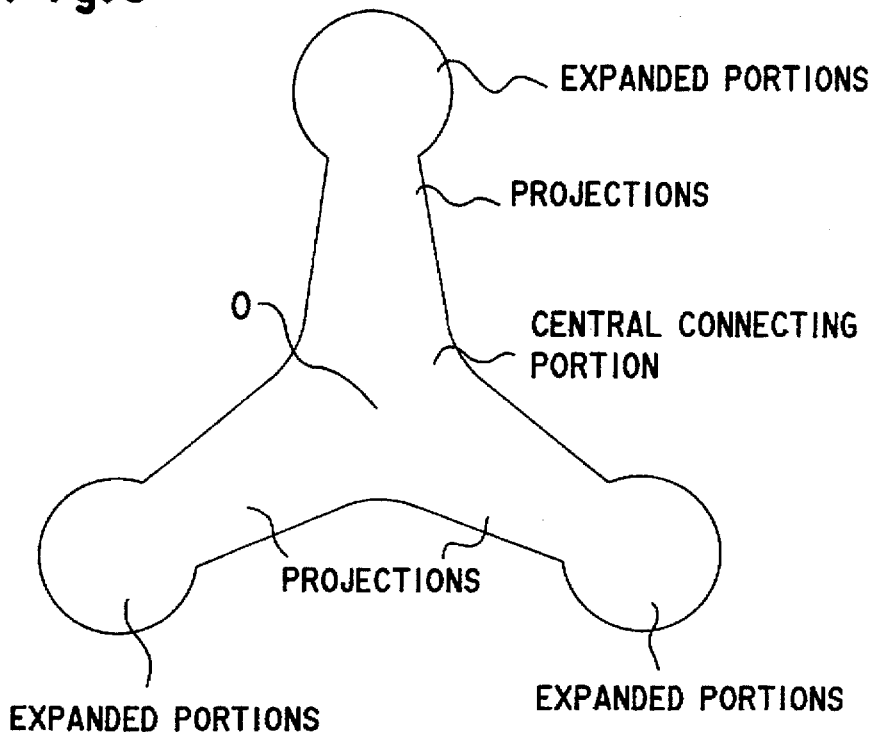
FIG. 5 is a view showing a cross-section of a spinning nozzle used in Examples 1, 3 and 4.

A copolymer resin composed of 49% by weight of acrylonitrile, 50% by weight of vinyl chloride, and 1% by weight of sodium styrenesulfonate was dissolved in acetone to prepare a 28% by weight spinning solution. The spinning solution was spun into a 30% by weight acetone aqueous solution through an approximately Y-shaped spinning nozzle having one central connecting portion and projections extended in three directions from the central connecting portion, each projection having an expanded portion at the top portion thereof, as shown in FIG. 5. A spinning draft at that time was 1.5.

The fiber thus obtained was subjected to stretching with a stretching ratio of 2 times in a state that the solvent remained in the fiber. The fiber was dried at 120° C., was subjected to stretching with a stretching ratio of 2.5 times, and was then subjected to a dry heat treatment at a temperature higher than the temperature at the drying. The fiber thus obtained had a cross-sectional shape as shown in FIG. 10(*a*), and had a single yarn fineness of 32 d.

The fiber obtained was bundled to obtain a bundle having a total fineness of 1,800,000 denier. When an apparent bulk specific gravity of the bundle before crimping was measured with a measurement vessel shown in FIG. 1, a height H was 2.5 cm ($E_0$=0.13). A half of the fiber bundle was subjected to crimping using a crimping machine having a gear pitch of 8 mm and a gear depth of 5 mm, and then subjected to setting with a comb. When an apparent bulk specific gravity of the fiber bundle thus treated was measured with the same measurement vessel as used above, a height H was 8.2 mm, and a weight C of the fiber bundle was 33.5 g ($E_1$=0.023).

Further, a fiber bundle which was subjected to crimping under the same conditions as in the measurement conditions above and then subjected to setting was formed into a three bundle-knitted article of 5 g and 30 corrugations (regular size) which was a representative braid, and a functional evaluation was performed on the bulkiness and the soft feeling as the braid.

The results obtained are shown in Tables 1 and 2 below.

COMPARATIVE EXAMPLE 1

Figure 6:
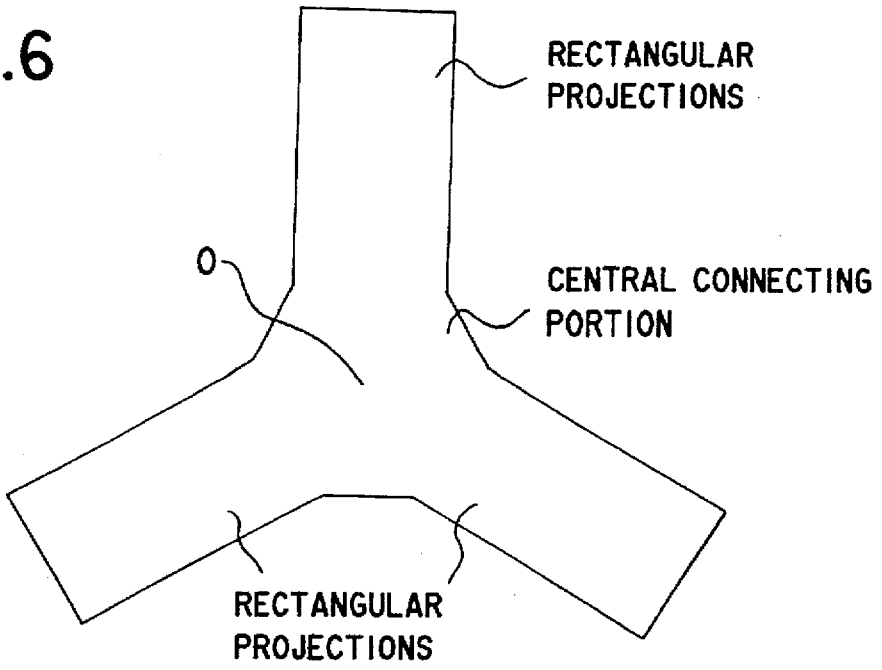
FIG. 6 is a view showing a cross-section of the spinning nozzle used in Comparative Example 1.

The copolymer resin as used in Example 1 above was dissolved in acetone to prepare a 28% by weight spinning solution. The spinning solution was spun into a 30% by weight acetone aqueous solution through an approximately Y-shaped spinning nozzle having a central connecting portion and projections extended in three directions from the central connecting portion as shown in FIG. 6. A spinning draft at that time was 1.2. The fiber thus obtained was subjected to drying, stretching and heat treatment in the same manner as in Example 1. The fiber had a cross-sectional shape as shown in FIG. 10(*c*), and had a single yarn fineness of 45 d.

The fiber was bundled to form a fiber bundle having a total fineness of 1,800,000 d. When an apparent bulk specific gravity of the fiber bundle before crimping was measured with the measurement vessel as shown in FIG. 1, a height H was 1.5 cm ($E_0$=0.22). The fiber bundle was subjected to crimping using a crimping machine and then subjected to setting in the same manner as in Example 1, and an apparent bulk specific gravity of the fiber bundle was measured with the same measurement vessel. As a result, a height H was 4.0 cm, and a weight G of the fiber bundle was 39 g ($E_1$=0.054).

Further, the fiber bundle which had been subjected to crimping and then setting in the same manner as in Example 1 was formed into a three-bundle knitted article of 5 g and 30 corrugations (regular size) which was a representative braid, and a functional evaluation was performed on the bulkiness and the soft feeling as the braid.

The results obtained are shown in Tables 1 and 2 below.

COMPARATIVE EXAMPLE 2

Figure 7:
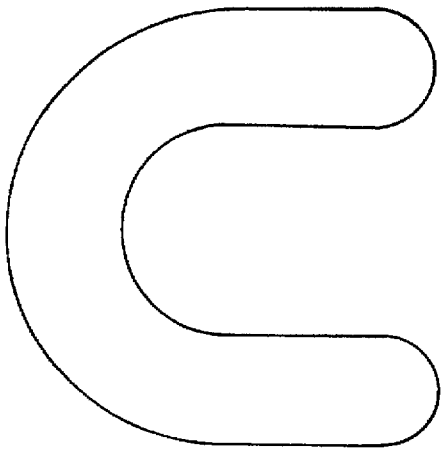
FIG. 7 is a view showing a cross-section of the spinning nozzle used in Comparative Example 2.
Figure 8:
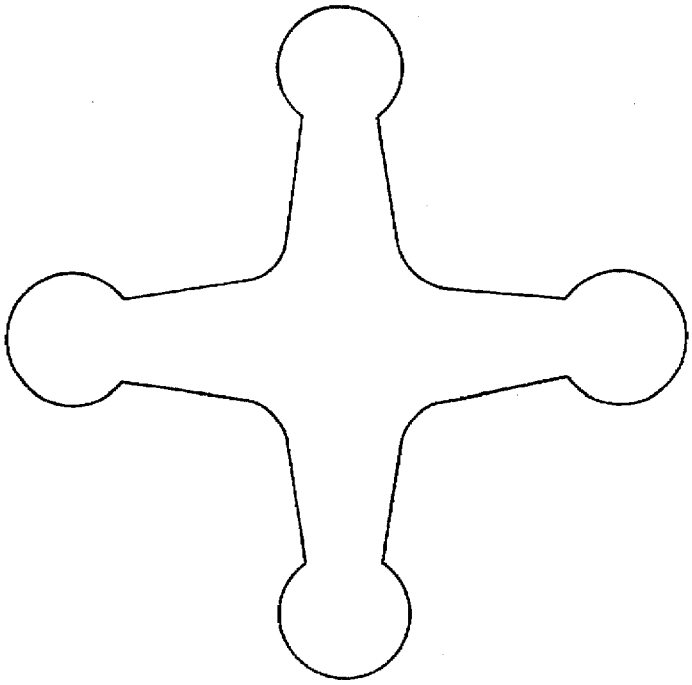
FIG. 8 is a view showing a cross-section of the spinning nozzle used in Example 2.

The same copolymer resin as used in Example 1 was dissolved in acetone to prepare a 28% by weight spinning solution. The spinning solution was spun in a 30% by weight acetone aqueous solution through an approximately C-shaped spinning nozzle as shown in FIG. 7. A spinning draft at that time was 1.2. The fiber was subjected to drying, stretching and heat treatment in the same manner as in Example 1. The fiber obtained had a cross-sectional shape as shown in FIG. 10(*d*), and had a single yarn fineness of 32 d. The fiber obtained was bundled to form a bundle having a total fineness of 1,800,000 denier, and an apparent bulk specific gravity of the bundle before crimping was measured with the measurement vessel as shown in FIG. 1. As a result, a height H was 1.8 cm ($E_0$=0.19).

Further, the fiber bundle was subjected to crimping using a crimping machine and then subjected to setting in the same manner as in Example 1, and an apparent bulk specific gravity of the bundle was measured with the same measurement vessel. As a result, a height H was 7.5 cm, and a weight G of the bundle was 44 g ($E_1$=0.033).

The fiber bundle which had been subjected to crimping and then setting in the same manner as in Example 1 was formed into a three-bundle-knitted article of 5 g and 30 corrugations (regular size) which was the representative braid, and a functional evaluation was performed on the bulkiness and the soft feeling.

The results obtained are shown in Tables 1 and 2 below.

EXAMPLE 2

The same copolymer resin as used in Example 1 was dissolved in acetone to prepare a 28% by weight spinning solution. The spinning solution was spun into a 30% by weight acetone aqueous solution through an approximately cross shaped spinning nozzle having a central connecting portion, and projections extended in four directions from the central connecting portion, each projection having an expanded portion at the top portion thereof. A spinning draft at that time was 1.1. The fiber was subjected to drying, stretching and heat treatment in the same manner as in Example 1. The fiber obtained had a cross-sectional shape as shown in FIG. 10(*b*), and had a single yarn fineness of 32 d. The fiber obtained was bundled to form a fiber bundle having a total fineness of 1,800,000 denier, and an apparent bulk specific gravity of the fiber bundle before crimping was measured with the measurement vessel as shown in FIG. 1. As a result, a height H was 1.7 cm ($E_0$=0.20).

The fiber bundle was subjected to crimping using a crimping machine and subjected to setting in the same manner as in Example 1, and an apparent bulk specific gravity of the fiber bundle was measured. As a result, a height H was 4.5 cm, and a weight G of the fiber bundle was 39.2 g ($E_1$=0.048).

Further, the fiber bundle which had been subjected to crimping and setting in the same manner as in Example 1 was formed into a three bundle-knitted article of 5 g and 30 corrugations (regular size) as the representative braid. A functional evaluation was performed on the bulkiness and the soft feeling as the braid.

The results obtained are shown in Tables 1 and 2 below.

COMPARATIVE EXAMPLE 3

Figure 9:
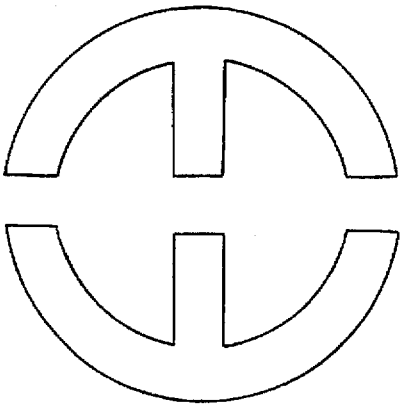
FIG. 9 is a view showing a cross-section of the spinning nozzle used in Comparative Example 3.
Figure 10A:
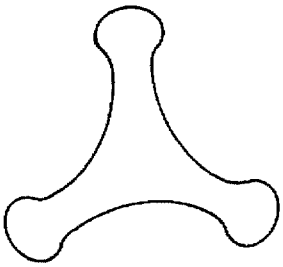
FIGS. 10(*a*) to 10(*e*) are cross-sectional views of fibers obtained in the Examples and the Comparative Examples, in which FIG. 10(*a*) is a cross-sectional view of the fiber obtained in Examples 1, 3 and 4, FIG. 10(*b*) is a cross-sectional view of the fiber obtained in Example 2, FIG. 10(*c*) is a cross-sectional view of the fiber obtained in Comparative Example 1, FIG. 10(*d*) is a cross-sectional view of the fiber obtained in Comparative Example 2, and FIG. 10(*e*) is a cross-sectional view of the fiber obtained in Comparative Example 3.
Figure 10B:
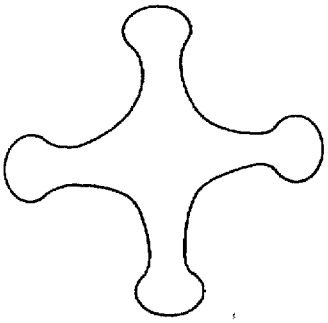
Figure 10C:
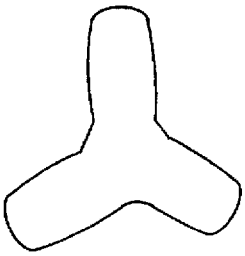
Figure 10D:
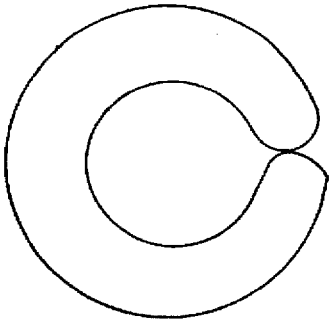
Figure 10E:
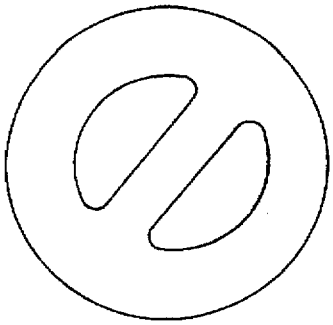

Polypropylene (MI (melt index according to JIS K7210) =10 g/min) was melt spun with a melt extruder using a spinning nozzle as shown in FIG. 9. Spinning temperature was 240° to 265° C., and drawing speed was 100 m/min. The fiber obtained was further stretched with a stretching ratio of 4 times to obtain a fiber having a single yarn fineness of 40 d. The fiber had a cross-sectional shape as shown in FIG. 10(*e*). The fiber obtained was bundled to form a bundle having a total fineness of 1,800,000 denier. When an apparent bulk specific gravity of the bundle before crimping was measured, a height H was 2.2 cm ($E_0$=0.15).

The fiber bundle was subjected to crimping using a crimping machine and subjected to setting in the same manner as in Example 1, and an apparent bulk specific gravity of the fiber bundle was measured with the same measurement vessel. As a result, a height H was 6.0 cm, and a weight G of the bundle was 38.6 g ($E_1$=0.036).

Further, the fiber bundle which had been subjected to crimping and setting in the same manner as in Example 1 was formed into a three bundle-knitted article of 5 g and 30 corrugations (regular size) which was the representative braid, and a functional evaluation was performed on the bulkiness and the soft feeling as the braid.

The results obtained are shown in Tables 1 and 2 below.

EXAMPLE 3

Polypropylene (MI (melt index according to JIS K7210) =10 g/min) was melt spun with a melt extruder using a spinning nozzle as shown in FIG. 5. Spinning temperature was 240° to 265° C., and a drawing speed was 100 m/min. The fiber obtained was stretched with a stretching ratio of 4 times to obtain a fiber having a single yarn fineness of 40 d. The fiber had a cross-sectional shape as shown in FIG. 10(*a*). The fiber was bundled to form a bundle having a total fineness of 1,800,000 denier. When an apparent bulk specific gravity of the fiber bundle before crimping was measured with the measurement vessel as shown in FIG. 1, a height H was 3.1 ($E_1$=0.11).

The fiber was subjected to crimping using a crimping machine, and subjected to setting in the same manner as in Example 1, and an apparent bulk specific gravity of the fiber bundle was measured with the same measurement vessel. As a result, a height H was 8.9 cm, and a weight G of the fiber bundle was 33.5 g ($E_1$=0.021).

Further, the fiber bundle which had been subjected to crimping and setting in the same manner as in Example 1 was formed into a three bundle-knitted article of 5 g and 30 corrugations (regular size) which was the representative braid, and a functional evaluation was performed on the bulkiness and the soft feeling as the braid.

The results obtained are shown in Tables 1 and 2 below.

EXAMPLE 4

Polyethylene terephthalate having a limiting viscosity of 0.53 was melt spun with a melt extruder using a spinning nozzle as shown in FIG. 5. Spinning temperature was 270° to 285° C., and a drawing speed was 100 m/min. The fiber obtained was stretched with a stretching ratio of 2 times in hot water at 75° C., stretched with a stretching ratio of 2.5 times in hot water, and heat treated with heater roll at 140° C. The fiber obtained had a cross-sectional shape as shown in FIG. 10(*a*), and had a single yarn fineness of 32 d. The fiber obtained was bundled to form a bundle having a total fineness of 1,800,000 denier. When an apparent bulk specific gravity of the bundle before crimping was measured with the measurement vessel as shown in FIG. 1, a height H was 1.75 cm ($E_0$=0.19).

The fiber bundle was subjected to crimping and setting in the same manner as in Example 1, and an apparent bulk specific gravity of the fiber bundle was measured with the same measurement vessel.

As a result, a height H was 5 cm, and a weight G of the fiber bundle was 45 g ($E_1$=0.050).

Further, the fiber bundle which had been subjected to crimping and setting in the same manner as in Example 1 was formed into a three bundle-knitted article of 5 g and 30 corrugations (regular size) which was the representative braid, and a functional evaluation was performed on the bulkiness and the soft feeling as the braid.

The results obtained are shown in Tables 1 and 2 below.

TABLE 1

| | Shape | W1/W2 | R/W1 | W1 max/W1 min | Rmax/Rmin | Fineness |
|---|---|---|---|---|---|---|
| Example 1 | Approximately Y shape | 1.13 | 3.1 | 1.55 | 1.27 | 32d |
| Example 2 | Approximately cross shape | 1.15 | 4.0 | 1.50 | 1.40 | 32d |
| Example 3 | Approximately Y shape | 1.42 | 2.5 | 1.70 | 1.40 | 40d |
| Example 4 | Approximately Y shape | 1.49 | 3.5 | 1.10 | 1.07 | 32d |
| Comparative Example 1 | Approximately Y shape | — | — | — | — | 45d |
| Comparative Example 2 | Approximately C shape | — | — | — | — | 32d |
| Comparative Example 3 | 1 shape | — | — | — | — | 40d |

TABLE 2

| | Apparent bulk | Apparent bulk | Crimped shape after setting (fiber length 100 mm unit) | | | |
|---|---|---|---|---|---|---|
| | specific gravity before crimping (E0) | specific gravity after crimping (E1) | Average total length of a height of a crest and a depth of a root (mm) | The number of repeating units | Functional evaluation of bulkiness | Functional evaluation of soft feeling |
| Example 1 | 0.13 | 0.023 | 5 mm | 5 units | ⊙ | ⊙ |
| Example 2 | 0.20 | 0.048 | 6 mm | 7 units | ○ | ○ |
| Example 3 | 0.11 | 0.021 | 5 mm | 5 units | ⊙ | ○ |
| Example 4 | 0.19 | 0.050 | 7 mm | 8 units | ○ | ⊙ |
| Comparative Example 1 | 0.22 | 0.054 | 5 mm | 8 units | Δ–x | Δ |
| Comparative Example 2 | 0.19 | 0.033 | 8 mm | 7 units | ○ | Δ |
| Comparative Example 3 | 0.15 | 0.033 | 5 mm | 8 units | ⊙ | x |

Evaluation Method and Evaluation Standard (Bulkiness)

⊙: Very excellent

: Excellent

Δ: Slightly poor x: Poor (Soft feeling)

⊙: Very soft

: Soft

Δ: Slightly hard x: Hard

The fibers for artificial hair according to the present invention have an apparent bulk specific gravity before crimping within a range of from 0.1 to 0.2 and an apparent bulk specific gravity after crimping and setting within a range of from 0.02 to 0.05. When the fiber for artificial hair according to the present invention is used for the decoration of hair on the head such as wigs, hair pieces, extension hair, or doll's hair, the fiber can provide articles having an excellent bulkiness and a soft feeling. In particular, the fiber for artificial hair according to the present invention exhibits a very excellent effect when used to form articles which require a bulkiness, such as hair pieces or braids.

What is claimed is:

1. Fiber for artificial hair comprising synthetic fibers, wherein an apparent bulk specific gravity of the synthetic fibers is within a range of from 0.02 to 0.05 a cross-sectional shape of the fiber is a modified cross-sectional shape comprising one central connecting portion, and projections extended in at least three directions from the central connecting portion, and part of the surface or the entire surface of the fiber is open in the direction of length of the fiber, the fiber having been subjected to crimping such that 5 to 10 crimping shapes as a repeating unit of a crest and a root are present in a length of 100 mm of fiber in an axial direction, wherein the total length of height of the crest and depth of the root, the crest and the root being adjacent with each other, is from 5 to 8 mm on average.

2. The fiber for the artificial hair as claimed in claim 1, wherein the synthetic fibers have a single yarn fineness of from 25 to 75 denier.

3. The fiber for the artificial hair as claimed in claim 1, wherein the cross-sectional shape of the synthetic fibers is an approximately Y-shaped cross-section having one central connecting portion, and projections extended in three directions from the central connecting portion.

4. The fiber for the artificial hair as claimed in claim 1, which is used for a decoration of hair on the head.

5. The fiber for the artificial hair as claimed in claim 4, wherein the decoration of hair on the head is wigs, hair pieces, braids, extension hair, or doll's hair.

6. The fiber for the artificial hair as claimed in claim 2, wherein the cross-sectional shape of the synthetic fibers is an approximately Y-shaped cross-section having one central connecting portion, and projections extended in three directions from the central connecting portion.

7. The fiber for the artificial hair as claimed in claim 2, which is used for a decoration of hair on the head.

8. The fiber for the artificial hair as claimed in claim 3, which is used for a decoration of hair on the head.

9. The fiber for the artificial hair as claimed in claim 6, wherein the decoration of hair on the head is wigs, hair pieces, braids, extension hair, or doll's hair.

10. The fiber for the artificial hair as claimed in claim 7, wherein the decoration of hair on the head is wigs, hair pieces, braids, extension hair, or doll's hair.

11. The fiber for the artificial hair as claimed in claim 8, wherein the decoration of hair on the head is wigs, hair pieces, braids, extension hair, or doll's hair.

* * * * *